US009004944B2

(12) United States Patent
Annequin et al.

(10) Patent No.: US 9,004,944 B2
(45) Date of Patent: Apr. 14, 2015

(54) CONNECTOR HAVING AN ARMATURE FOR FASTENING THE CONNECTOR TO A PRINTED CIRCUIT BOARD

(75) Inventors: Sébastien Annequin, Voiron (FR); Denis Gabet, La Buisse (FR)

(73) Assignee: Raydiall, Voiron (FR)

( * ) Notice: Subject to any disclaimer, the term of this patent is extended or adjusted under 35 U.S.C. 154(b) by 0 days.

(21) Appl. No.: 13/324,333

(22) Filed: Dec. 13, 2011

(65) Prior Publication Data

US 2012/0156921 A1 Jun. 21, 2012

(30) Foreign Application Priority Data

Dec. 16, 2010 (FR) ..... 10 60607

(51) Int. Cl.
*H01R 13/648* (2006.01)
*H01R 13/6594* (2011.01)
*H01R 12/72* (2011.01)

(52) U.S. Cl.
CPC ..... *H01R 13/6594* (2013.01); *H01R 12/724* (2013.01); *H01R 2201/26* (2013.01)

(58) Field of Classification Search
USPC ..... 439/63, 607.13, 607.38
See application file for complete search history.

(56) References Cited

U.S. PATENT DOCUMENTS 4,637,669 A * 1/1987 Tajima ..... 439/95
4,913,664 A 4/1990 Dixon et al.
5,387,114 A * 2/1995 Brunker et al. ..... 439/108
5,927,999 A 7/1999 Shimojyo
6,319,062 B1 * 11/2001 Ma et al. ..... 439/607.38
D456,355 S 4/2002 Togashi
6,468,108 B1 * 10/2002 Wu ..... 439/567
7,137,825 B2 * 11/2006 Myer et al. ..... 439/63
7,794,277 B1 9/2010 Peng
2005/0221673 A1 10/2005 Myer et al.
2007/0049124 A1 3/2007 Chien et al.
2007/0224883 A1 9/2007 Chan et al.
2008/0124956 A1 5/2008 Wu
2009/0247013 A1 10/2009 Tsuzaki et al.
2010/0055979 A1 3/2010 Wang et al.
2010/0075542 A1 3/2010 Ho
2010/0105226 A1 4/2010 Gong et al.
2010/0233905 A1 * 9/2010 Nagata ..... 439/607.13

OTHER PUBLICATIONS

French Search Report issued in French Application No. 10 60607 on Jun. 16, 2011 (with translation).
French Written Opinion issued in French Application No. 10 60607 on Jun. 16, 2011 (with translation).

* cited by examiner

*Primary Examiner* — Chandrika Prasad
(74) *Attorney, Agent, or Firm* — Oliff PLC

(57) ABSTRACT

A connector having a body, at least one contact accommodated in the body with an insulator being interposed, a casing defining a housing designed to accommodate all or part of the body, and an armature placed around at least one portion of the casing, at least one portion of the body being accommodated in the portion of the casing, the armature having feet for fastening the connector to a printed circuit board, wherein the feet project beyond that portion of the casing around which the armature is placed and wherein the armature is placed in a set-in manner relative to the casing.

16 Claims, 7 Drawing Sheets

Fig.21
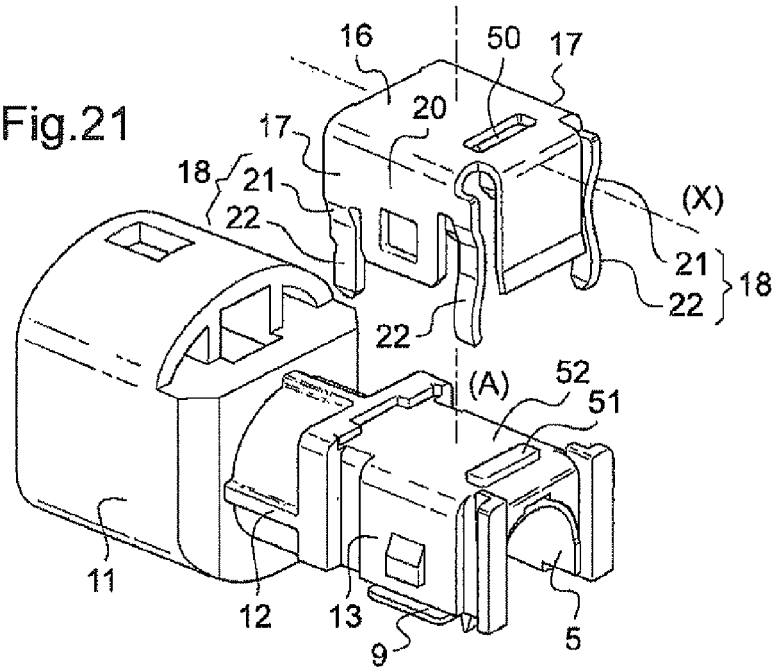
Fig.22
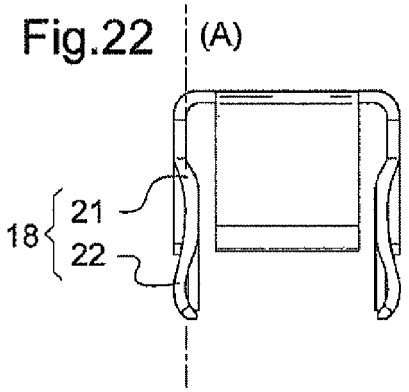
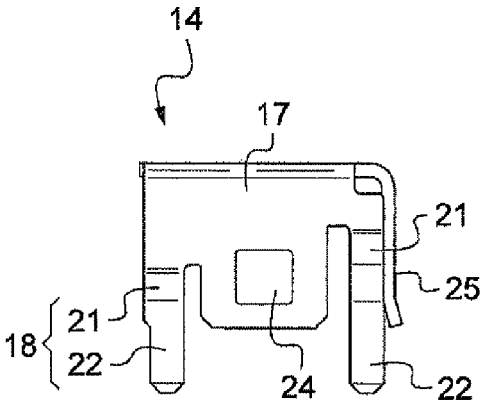
Fig.23

CONNECTOR HAVING AN ARMATURE FOR FASTENING THE CONNECTOR TO A PRINTED CIRCUIT BOARD

BACKGROUND

The subject of the present invention is a connector for a printed circuit board.

The invention applies for example to a coaxial connector produced according to the FAKRA (Standards Commission for the Automotive Industry) standardization scheme.

In the context of the invention, a "coaxial connector according to the FAKRA standardization scheme" denotes a coaxial connector comprising a body, the mechanical dimensions of which in an axial cross section of said body, cooperating with the body of a complementary connector in order to establish a mechanical connection between the two bodies, are defined in the DIN 72594-1 standard. Such connectors are generally used in the automotive field for data transmission cables.

The invention may also apply to connectors for high rate transmission circuits (LVDS).

FIGS. 1 and 2 show an example of a connector denoted overall by 1 and generally used for fastening to a printed circuit board. This connector is an elbow connector and comprises a metal body 2 produced by machining or casting, said body 2 being connected to a plastic casing 3 defining a mechanical and electrical connection interface. It is desirable for the body 2 of the connector 1 to have a small thickness so as to produce a satisfactory connection interface. However, given that with a connector according to FIGS. 1 and 2 the tensile forces on the casing 3 occurring during use are directly transmitted to the body 2, the latter must be sufficiently resistant thereto.

In the example shown in FIGS. 1 and 2, the connector 1 also includes a metal cap 4 closing off one end of the body 2 and making it possible to provide high-frequency shielding when the connector 1 is fastened to the printed circuit.

Because of the way the body 2 is produced by machining or casting, such a connector is relatively expensive.

SUMMARY

It is known to reduce the cost of manufacturing the parts, and especially the body, of a connector using what is called the "cut-and-rolled" technique. However, a connector body produced using this technique and having a small thickness, so as to meet the abovementioned constraints of the connection interface, would be too fragile owing to the abovementioned stresses exerted on said body.

There is a need to benefit from a connector comprising elements that can be manufactured for a reduced cost, while still being sufficiently robust.

The connector disclosed by the utility model US D456 355 S teaches the provision of a connector with an armature for taking up the tensile forces. This connector is a straight connector specific for "board edge" fitting, having a central contact extending in a plane parallel to that of the printed circuit board. The fitting of such a connector to the printed circuit board then requires a cavity to be provided in the board for accommodating the body of the connector. The benefit of such a connector may thus be limited by the constraints associated with its fitting and also by the use of an EMI (electromagnetic interference) shield.

There is a need to remedy the drawbacks of the known connectors according to FIGS. 1 and 2 while allowing greater fitting freedom than with the connector according to the utility model US D456 355 S.

The aim of the invention is to meet this need and it succeeds in doing so, according to one of its aspects, by a connector comprising:

- a body;
- at least one contact accommodated in the body with an insulator being interposed;
- a casing defining a housing designed to accommodate all or part of the body; and
- an armature placed around at least one portion of the casing, at least one portion of the body being accommodated in said portion of the casing, the armature having feet for fastening the connector to a printed circuit board, wherein said feet project beyond that portion of the casing around which the armature is placed.

Thanks to the presence of the armature, the mechanical forces are taken up with the printed circuit board by the casing and the armature. Thus, the tensile forces on the casing are transmitted to the armature but not to the body of the connector.

The connector obtained may be an SMC (surface mount component) connector of the "pin-in-paste" type (that is to say one using solder paste for melt-soldering the components) or else of the "wave soldering" type.

The armature may be made of metal, especially brass or bronze, especially made as a single piece, in particular using the "cut-and-rolled" technique. In this way it is possible to reduce the cost of manufacturing the parts, despite the small thickness obtained since the forces are taken up over the entirety of the armature.

Advantageously, the casing is made of a plastic, for example a polyamide filled with glass fibers. The casing extends for example along a straight longitudinal axis.

The armature may comprise at least one contact arm extending beyond that portion of the casing around which the armature is placed. This contact arm may allow an electrical contact to be produced between the armature and one or more chassis located close to the connector.

The armature may have a substantially U-shaped cross section. The armature may thus comprise a back and two flanges. That portion of the casing around which the armature is placed may be of rectangular cross section, the armature especially extending only along all or part of three sides of this portion of the casing. The armature may be sandwiched in a groove of the casing or between two walls (or ends) of the casing. This configuration may allow the forces to be taken up by the armature.

According to a first embodiment of the invention, the connector is an elbow connector, that is to say it extends along two intersecting axes, especially perpendicular axes. One of the axes of the connector may correspond to the longitudinal axis of the casing.

The back of the armature may have at least one relief cooperating with a complementary relief provided by the face of the portion of the casing which is intended to be covered by the back. The armature includes for example a cavity and said face of the casing then includes a projecting portion, such as a key, designed to be accommodated in the cavity. As a variant, the armature has a projecting portion, such as a key, and said face of the casing includes a cavity into which the projecting portion of the armature is accommodated.

These complementary reliefs of the armature and of said face of the casing may promote retention by the armature of the connector on the printed circuit board on which it is mounted when a tensile force is exerted on the casing. Such a tensile force, together with the position of the center of gravity of the connector, not facing the printed circuit board, is capable of mainly tilting the casing relative to this printed circuit board.

Furthermore, these complementary reliefs may constitute polarizing means between the armature and the casing, so as to ensure that a given armature is properly mounted on the appropriate casing. These complementary reliefs may be of any dimension and shape and there may be any number thereof.

The armature may include a portion closing off a longitudinal end of the casing. By virtue of such a portion of the armature, high-frequency shielding is possible when the connector is fastened to the printed circuit board, the connector being imprisoned inside the casing.

According to this first embodiment of the invention, the feet of the armature may extend generally perpendicular to the longitudinal axis of the casing. The term "generally perpendicular" means that these feet may either include at least one part perpendicular to the longitudinal axis of the casing or include at least one curved part extending on either side of an axis perpendicular to the longitudinal axis of the casing. In the latter case, the thickness of the feet may be small enough to give them a flexible character and the curved part may promote retention of the armature on the printed circuit board, and therefore of the connector, despite forces exerted thereon and despite the position of the center of gravity thereof.

The armature may further include feet having a part perpendicular to the longitudinal axis of the casing and feet having a curved part extending on either side of an axis perpendicular to the longitudinal axis of the casing. The feet with the curved part may be the feet furthest away from the end of the casing, namely the end intended to be connected to a casing of a complementary connector.

According to a second embodiment of the invention, the connector is straight, that is say it extends only along a single axis, especially the longitudinal axis of the casing, and the feet of the armature extend parallel to said longitudinal axis of the casing.

The armature may include at least one tongue, and at least one catching foot may be provided on the outer surface of the body, it being possible for said tongue and said foot to be designed to keep the body in place in the casing.

As a variant, the casing comprises at least one tongue, and at least one catching foot is provided on the outer surface of the body, said tongue and said foot being designed to keep the body in place in the casing.

In the above two embodiments of the invention, the casing may extend longitudinally on either side of said armature, that is to say beyond each longitudinal end thereof. The armature may be placed in a set-in manner relative to the casing. In particular, the armature may be located longitudinally between at least two parts of the casing. This configuration may allow the tensile forces to be taken up along the axis of the body.

Yet another subject of the invention, according to another of its aspects, is a connection assembly comprising at least two connectors according to the first embodiment that has just been described, the armature of the first connector being connected to the armature of the second connector by a joining part carrying feet.

The armature of the first connector and the armature of the second connector and the joining part may be produced as a single piece, especially by virtue of the low-cost "cut-and-rolled" technique.

The feet provided on the joining part may be fastened by soldering to the printed circuit board. By virtue of such a connection assembly, it is possible for several casings to be soldered simultaneously.

Yet another subject of the invention, according to another of its aspects, is a connection assembly comprising at least two connectors according to the second connector embodiment according to the invention, the armature of the first connector being connected to the armature of the second connector by a joining part and/or the casing of the first connector and the casing of the second connector being made as a single piece.

When the armature of the first connector and the armature of the second connector are made as a single piece, the resulting armature of the connection assembly may have a U-shaped cross section with a back and flanges.

In all the abovementioned embodiments of the invention, the armature may be mechanically attached to the casing, for example by the cooperation of reliefs, by interlocking or snap-fastening. When the armature is placed around the casing, it cannot be in contact with the body of the connector. The connector is for example a coaxial connector. The connector may comprise a plurality of central contacts.

When the connector is an elbow connector, the contact(s) of the connector may be made as a single piece, or, as a variant, may be obtained by virtue of two straight contact portions connected together.

In all the above embodiments, the armature may be accommodated in the thickness of the casing, that is to say the wall of that portion of the casing around which the armature is placed may have recesses and the armature may be accommodated in these recesses when it is placed around said portion of the casing. Where appropriate, the thickness of the flanges and of the back of the armature may correspond to the thickness of said recesses.

Yet another subject of the invention, according to another of its aspects, is an elbow connector comprising:

a body;

at least one contact accommodated in the body with an insulator being interposed;

a casing extending along a longitudinal axis and defining a housing designed to accommodate all or part of the body; and an armature surrounding, along the longitudinal axis, at least one portion of the casing in which at least one portion of the body is accommodated, the armature having feet for fastening the connector to a printed circuit board, in which the armature has a wall transverse to the longitudinal axis of the casing, said wall closing off a longitudinal end of the casing.

Yet another subject of the invention, according to another of its aspects, is a system comprising:

a connector having a body, at least one contact accommodated in the body with an insulator being interposed, a casing defining a housing designed to accommodate all or part of the body, and an armature placed around at least one portion of the casing, the armature having feet for fastening the connector to a printed circuit board; and a printed circuit board, wherein the contact extends along a longitudinal axis, at least one portion of which is inclined, especially being perpendicular, to the plane defined by the printed circuit board.

The plane defined by the printed circuit board is that in which the width and the length of the printed circuit board are measured.

Thanks to the inclined, and especially perpendicular, portion of the contact of the connector relative to the plane defined by the printed circuit board, other ways of fitting the connector, that is to say other than those of the "board edge" type, may be envisioned.

The connector may be straight, in which case the contact is straight and may extend over its entire length so as to be inclined, especially perpendicularly, to the plane defined by the printed circuit board.

As a variant, the connector may be an elbow connector, in which case the contact is right-angled and may include a portion extending so as to be inclined, especially perpendicularly, to the plane defined by the printed circuit board.

The feet of the connector may extend so as to be inclined, especially perpendicularly, to the plane defined by the printed circuit board.

The connector, especially the body, the casing or the armature, may be as described above, comprising for example at least any one of the aforementioned features.

BRIEF DESCRIPTION OF THE DRAWINGS

The invention will be better understood on reading the following description of nonlimiting exemplary embodiments thereof and by examining the appended drawing in which:

FIG. 21 is an exploded view of the connector shown in FIG. 19; and FIGS. 22 and 23 are isolated views of the armature shown in FIG. 21, on XXII and XXIII respectively.

DETAILED DESCRIPTION OF EMBODIMENTS

Figure 1:
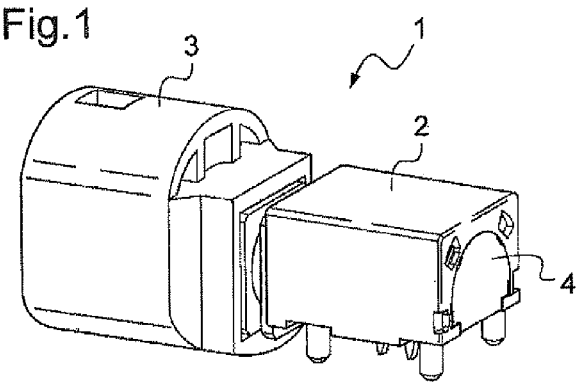
FIGS. 1 and 2 show a connector according to the prior art, already described.
Figure 2:
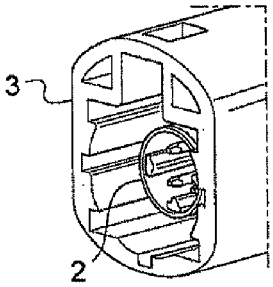

FIGS. 3 to 6 show a connector 10 according to a first exemplary embodiment of the invention. This connector 10 is designed to be mounted on a printed circuit board 19, visible in FIGS. 9 and 18. The connector 10 here is an elbow connector.

The connector 10 comprises in the example described a body 2 accommodated in a housing 6 (i.e., in an interior space) of a casing 3.

Figure 4:
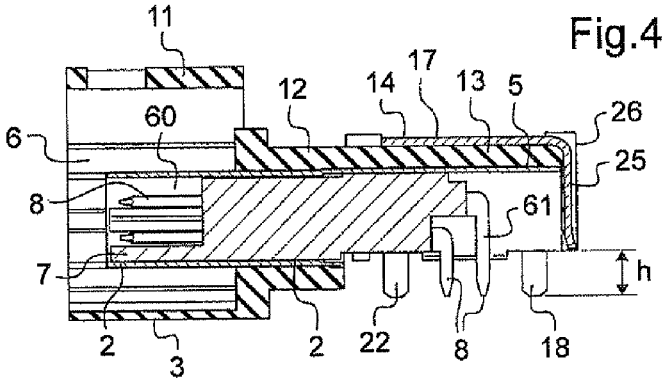
Figure 5:
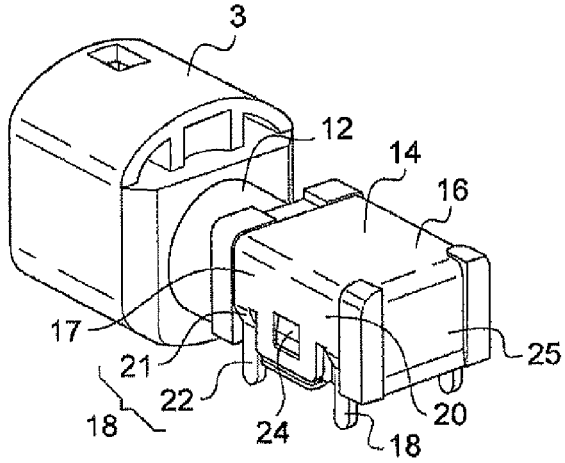

The body 2 is for example made of metal, especially brass or bronze, using the "cut-and-rolled" technique. As may be seen in FIG. 4, the body 2 accommodates an insulator 7 inside of which a plurality of central contacts 8 are placed. The central contacts 8 here are right-angled, that is to say they extend along a longitudinal axis comprising, as shown in FIG. 4, two portions 60 and 61 making an angle, in the example described of 90°, between them. Each central contact 8 may be monolithic or produced by two straight portions connected together.

The casing 3 extends in this example along a straight longitudinal axis X. The casing 3 is for example made of plastic, especially a polyamide filled with glass fibers. In the example illustrated, the casing 3 comprises a front portion 11 especially having reliefs for connection to a casing of a complementary connector, a tubular central portion 12, the inside diameter of which allows the body 2 to be accommodated therein, and a rear end portion 13 around which an armature 14 (e.g., a cover, a shield or a shell) is placed.

Figure 3:
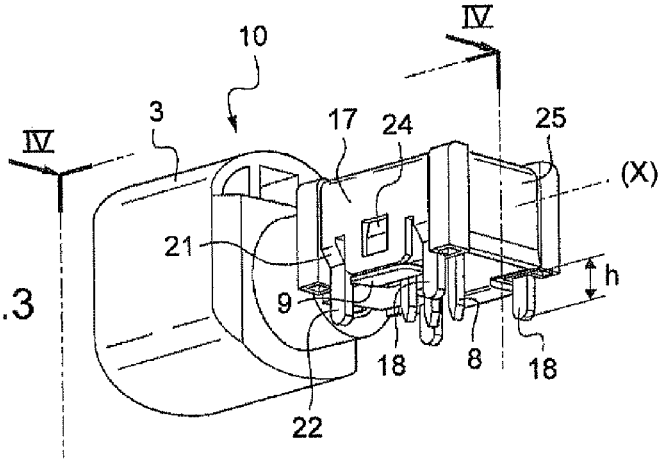
FIGS. 3 to 6 show a connector according to a first exemplary embodiment of the invention, FIG. 4 being a view in longitudinal section along IV-IV of FIG. 3, FIGS. 7 and 8 show schematically a connection assembly comprising connectors according to FIGS. 3 to 6.

As shown in FIGS. 3 and 4, the rear portion 13 of the casing 3 may have a U-shaped cross section. This rear portion 13 of the casing accommodates a part 5 of the body which also has a U-shaped cross section, this part 5 having returns 9 folded against a free edge of the rear portion 13 of the casing so as to keep the body 2 in position in the housing 6.

The armature 14 is made of metal, especially brass or bronze.

In the example of FIGS. 3 to 6, the armature 14 has a U-shaped cross section perpendicular to the axis X of the casing 3. This armature 14 comprises, in the example shown in FIGS. 3 to 6, a back 16 and two flanges 17, the latter being joined by the back 16. The armature is for example made as a single piece.

In the example described, the back 16 has a substantially smooth surface.

As a variant, the back 16 may include, as shown in the example of FIGS. 18 to 23, a cavity 50. The cavity 50 is for example provided right through the thickness of the back and may be designed to cooperate with a projecting relief 51 provided on the upper face 52 of the rear portion 13 of the casing 3, this upper face 52 being covered by the back 16 of the armature 14 when the latter is in place on the portion 13 of the casing 3. The projecting relief 51 is for example a key.

Figure 9:
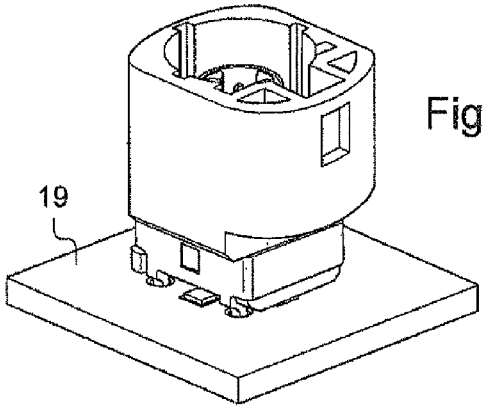
FIG. 9 shows a connector according to a second exemplary embodiment of the invention.
Figure 10:
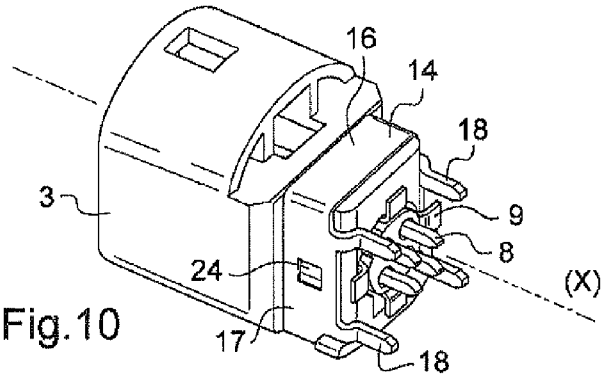
FIGS. 10 to 12 show a first variant of the connector according to FIG. 9, FIG. 11 being a view in longitudinal section along XI-XI of the connector of FIG. 10, FIGS. 13 and 14 show a second variant of the connector according to FIG. 9, FIG. 14 being a view in longitudinal section on XIV-XIV of the connector of FIG. 13, FIGS. 15 to 17 show a connection assembly comprising connectors according to FIGS. 9 to 14.

The armature 14 also includes feet 18 for fastening the connector 10 to a printed circuit board 19, visible in FIG. 9. The armature has for example a plurality of feet 18 provided by each flange 17, for example two feet 18 for each flange 17. These feet 18 may or may not have the same length.

In the example of FIGS. 3 to 6, the feet 18 extend perpendicular to the axis X of the casing 6.

The feet 18 project from the rear portion 13 of the casing 3, for example by a distance h of between 0.5 mm and 1 cm, especially between 0.6 and 4 mm.

As may be seen in FIGS. 3 to 6, the rear portion 13 of the casing 3 extends longitudinally beyond the longitudinal ends of the flanges 17.

Each flange 17 may extend from the back 16 of the armature 14 along a plane surface 20. This plane surface 20 is in the example described connected to each foot 18.

Each foot may have a distal part 22 extending parallel to the plane surface 20 and a proximal part 21, connected to the surface 20 and extending obliquely to the latter. Each proximal part 21 is for example turned toward the inside of the armature 14. The distal part 22 of each foot 18 is for example designed to pass through an opening provided in the printed circuit board 19.

However, the invention is not limited to feet having a distal part 22 parallel to the surface 20 of the armature.

In the variant shown in FIGS. 18 to 23, and especially in FIGS. 21 to 23, the armature 14 furthermore includes feet 18 having a curved distal part 22, this distal part 22 extending on either side of an axis (A) parallel to the surface 20 of the armature 14.

As may be seen in FIGS. 3 to 6, each flange 17 may include a hole 24, the latter being for example provided in the plane surface 20 and cooperating with a relief, such as a barb, provided on the outer surface of the rear portion 13 of the casing, so as to attach the armature 14 to the rear portion 13 of the casing 3.

The holes 24 may be of any shape, being square in the example described. The armature 14 further includes, in the examples of FIGS. 3 to 6, a portion 25 extending substantially perpendicular to the longitudinal axis X of the casing 3 and closing off the longitudinal end 26 of the casing 3 at the rear portion 13 thereof.

In the examples that have just been described, the flanges 17 and the back 16 of the armature 14 may be accommodated in the thickness of the rear portion 13 of the casing 3, that is to say in recesses provided in the flanges 17 and the back 16 of the armature 14. The armature 14 may be sandwiched between walls or ends 26 of the casing 3, as may be seen for example in FIG. 7.

Figure 6:
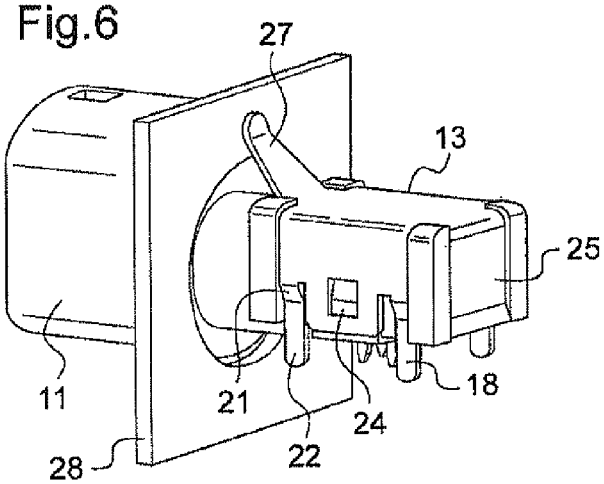

As shown in FIG. 6, the armature 14 may comprise a contact arm 27 extending beyond the rear portion 13 of the casing. This contact arm 27 extends for example in the direction of the tubular portion 12 of the casing 3 and may come into contact with a chassis 28 located close to the connector 10.

Figure 7:
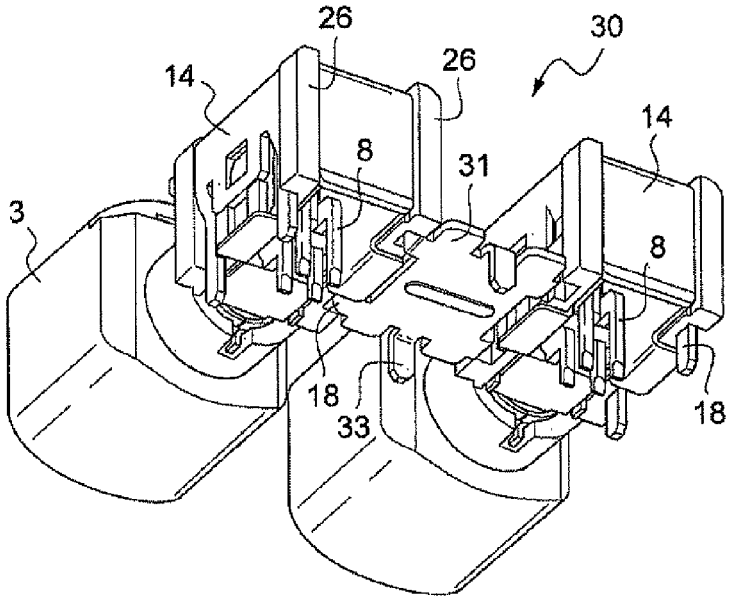
Figure 8:
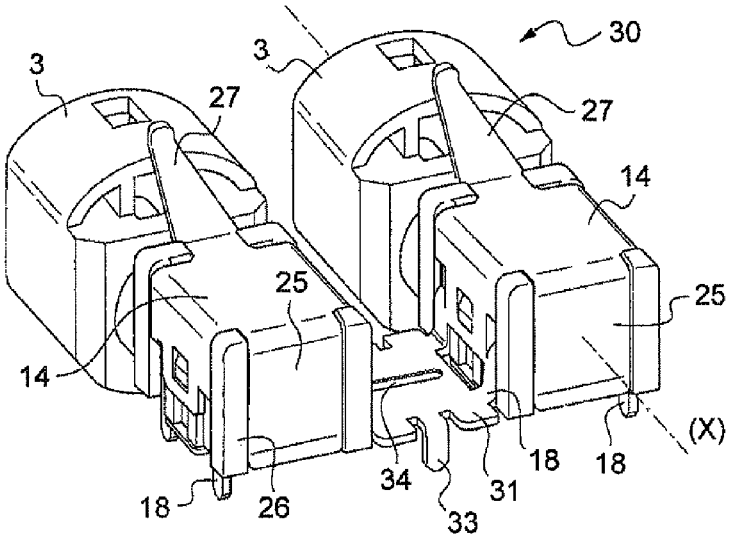

FIGS. 7 and 8 show an example of a connection assembly 30 comprising connectors 10 as described above. Although the connection assembly 30 has only two connectors 10 in the example considered, the invention is not limited to one particular number of connectors 10.

The assembly comprises a joining part 31 connecting the armatures 14 of each of the connectors 10. In the example illustrated, this joining part 31 is plane and has feet 33 similar to the feet 18 described above. As may be seen in FIG. 8, this joining part 31 has a relief 34 provided over the major part of its width, perpendicular to the longitudinal axis of each connector 10, this relief 34 making it possible in particular stiffen the joining part 31.

In the example illustrated, the joining part 31 is made as a single piece with the armatures 14 of the two connectors, the connection between armatures 14 and the joining part 31 taking place by means of the feet 18 of the flanges 17 opposite the joining part 31, said feet 18 being curved and connected to the joining part 31.

The connection assembly 30 shown in FIGS. 7 and 8 is fastened to a printed circuit board by soldering the feet 18 not opposite the joining part 31 and the feet 33 of said joining part 31 to the printed circuit board.

Connectors 10 according to a second exemplary embodiment of the invention will now be described with reference to FIGS. 9 to 14.

The connectors according to this second embodiment of the invention differ in particular from those that have just been described by the fact that they are straight, that is to say they extend only along a single straight longitudinal axis, the central contacts being straight.

In the examples shown in FIGS. 9 to 14, the feet 18 of the armature extend parallel to the longitudinal axis X of the casing 3, which here is the longitudinal axis of the connector 10.

Figure 11:
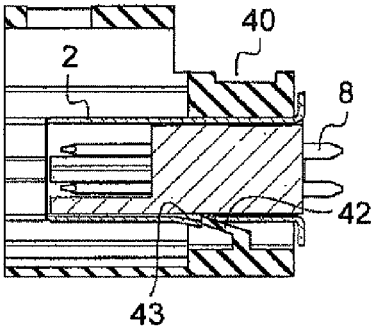
Figure 12:
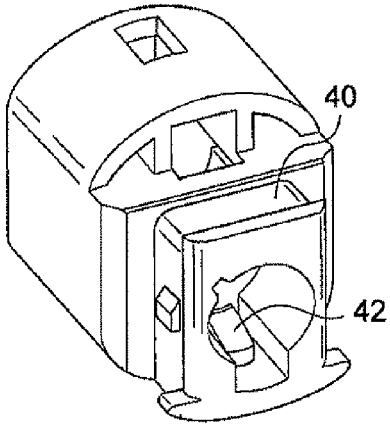

As shown in FIGS. 11 and 12, in which the armature 14 has not been shown for the sake of clarity, the back 16 of the armature 14 is accommodated in a groove 40 provided in the rear portion 13 of the casing, this groove 40 extending perpendicular to the longitudinal axis X of the casing. The armature 14 may be sandwiched in the groove 40. The casing 3 extends on either side of the longitudinal axis X, along with the armature 14. This configuration makes it possible for the forces to be taken up by the armature.

The body 2 of the connector 10 includes, as described above, returns 9 which in the example illustrated are folded against the longitudinal end 26 of the casing 3 at the rear portion 13 of the latter.

In the example of FIG. 11 and FIG. 12, a tongue 42 is provided on the inner surface of the rear portion 13 of the casing 3 and a catching foot 43 is provided on the outer surface of the body 2, said tongue 42 and said foot 43 being designed to keep the body 2 in place in the housing 6 of the casing 3.

Figure 13:
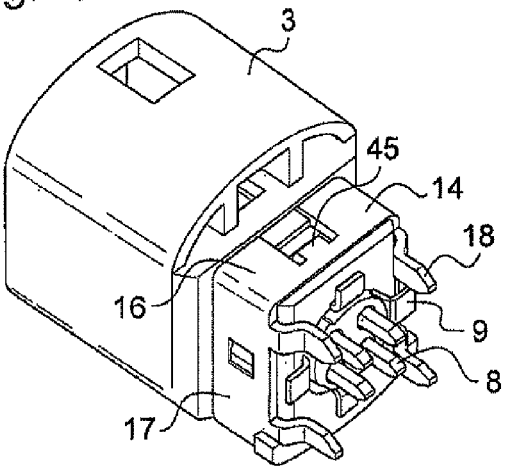
Figure 14:
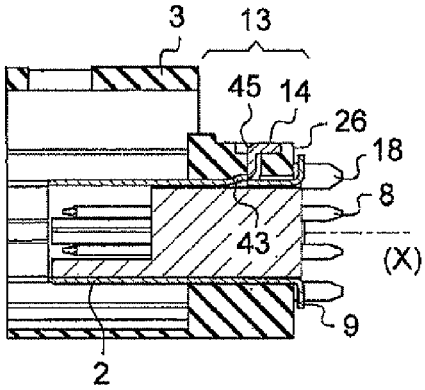

In the example shown in FIGS. 13 and 14, a tongue 45, cut into the armature 14 and folded, for example on the back 16 of the armature 14, may be provided as a complement to or replacement of the tongue 42 described with reference to FIGS. 11 and 12, this tongue cooperating with the catching foot 43 for keeping the body in place in the housing 6 of the casing 3.

A connection assembly 30 comprising connectors according to FIGS. 9 to 14 will now be described with reference to FIGS. 15 to 17.

In these examples, the casings 3 of each of the connectors 10 are made as a single piece, forming a common casing in which two through-housings 6 are provided, each of these through-housings accommodating one of the connectors 10.

Figure 15:
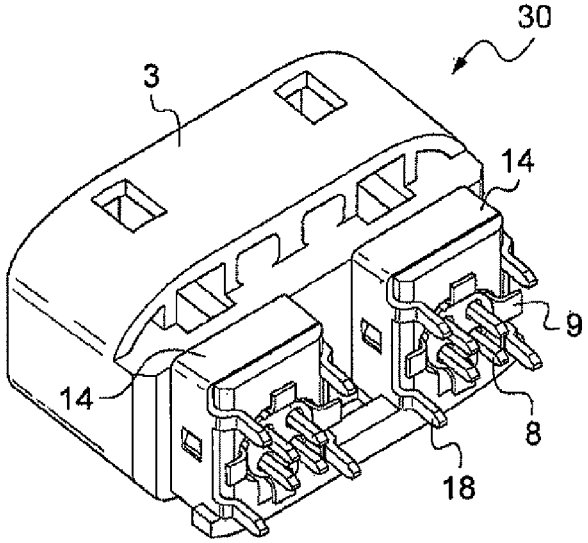
Figure 16:
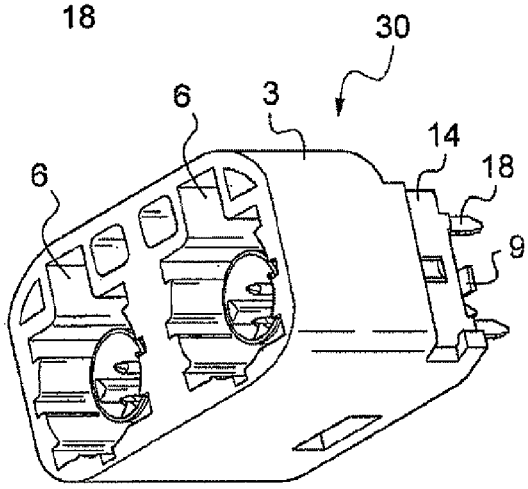

In the example of FIG. 15, each of the connectors 10 has its own armature 14, similar to the armatures described with reference to FIGS. 9 to 14, In the example of FIG. 17, the back 16 of the armature of the first connector 10 is connected to the back 16 of the armature of the second connector by a joining part 47. This joining part 47 may be made as a single piece with each of the backs 16 and may form an overall armature for the connection assembly 30, comprising a back consisting of each back 16 and of the joining part 47, and two flanges belonging to the respective armature of each connector.

Figure 17:
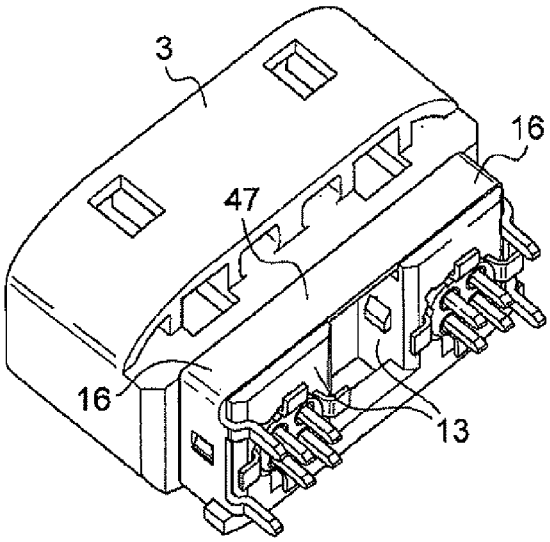

As may be understood in the view shown in FIG. 17, the opposing faces of rear portions 13 of the casing 5 may have no armature.

Figure 18:
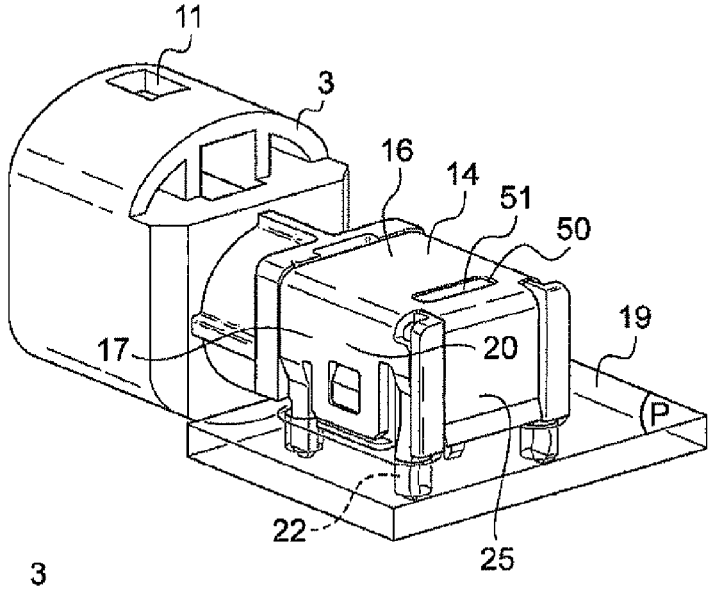
FIG. 18 shows a variant of the connector shown in FIGS. 3 to 6, FIG. 19 differs from FIG. 18 only by the absence of the printed circuit board.
Figure 19:
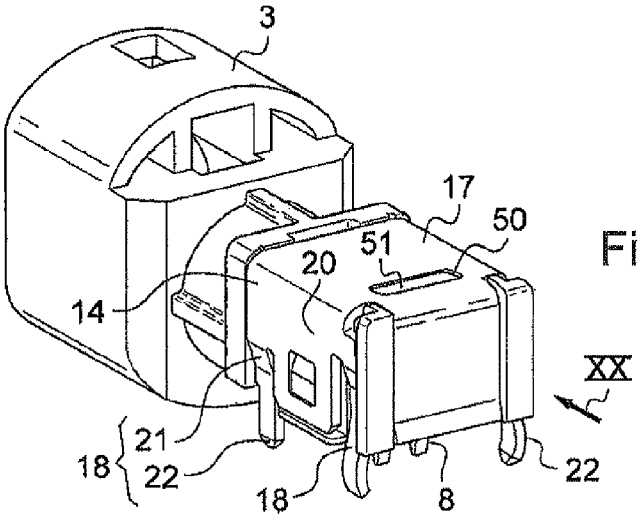
Figure 20:
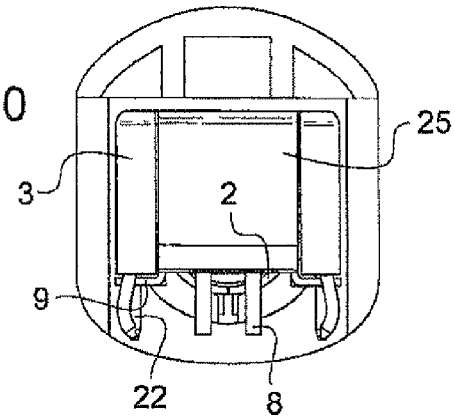
FIG. 20 is a view on XX of the connector shown in FIG. 19.

As may be understood in the view shown in FIG. 18, in the case of an elbow connector, the central contacts 8 may each have a portion 61 perpendicular to the plane P defined by the printed circuit board 19.

Furthermore, as may be understood in the view shown in FIG. 9, in the case of a straight connector, each central contact 8 may be entirely or only partly perpendicular to the plane P defined by the printed circuit board.

The invention is not limited to the examples that have just been described.

The presence of the reliefs 50 and 51 described with reference to FIGS. 18 to 23 is especially inseparable from the curved distal parts 22 of the feet 18.

The invention claimed is:

1. A connector, comprising:

a body;

at least one contact accommodated in the body with an insulator being interposed;

a casing designed to accommodate all or part of the body; and an armature placed around at least one portion of the casing, at least one portion of the body being accommodated in said portion of the casing, the armature having feet for fastening the connector to a printed circuit board, wherein:

said feet project beyond that portion of the casing around which the armature is placed;

the armature is placed in a set-in manner relative to the casing, the armature includes a back and flanges that are perpendicular to the back, and both the back and the flanges of the armature are sandwiched between walls or ends of the casing or in a groove provided in a rear portion of the casing, the groove extending perpendicular to a longitudinal axis of the casing.

2. The connector as claimed in claim 1, wherein the armature is made of metal.

3. The connector as claimed in claim 1, wherein the armature comprises at least one contact arm extending beyond that portion of the casing around which the armature is placed.

4. The connector as claimed in claim 1, which is an elbow connector, wherein the casing extends along the longitudinal axis and the armature includes a portion closing off a longitudinal end of the casing.

5. The connector as claimed in claim 4, wherein the feet of the armature extend generally perpendicular to said longitudinal axis.

6. The connector as claimed in claim 5, wherein at least one foot comprises a curved distal part extending on either side of an axis perpendicular to the longitudinal axis of the casing.

7. The connector as claimed in claim 4, wherein:

the armature has a substantially U-shaped cross section, comprising the back and the flanges, and the back of the armature has a relief designed to cooperate with a complementary relief provided by a face of a portion of the casing and intended to be covered by the back of the armature.

8. A connection assembly comprising at least two connectors as claimed in claim 4, wherein the armature of the first connector is connected to the armature of the second connector by a joining part bearing feet.

9. The assembly as claimed in claim 8, wherein the armature of the first connector, the armature of the second connector and the joining part are made as a single piece.

10. The connector as claimed in claim 1, which is straight and the feet of the armature extend parallel to the longitudinal axis of the casing.

11. The connector as claimed in claim 10, wherein the armature has at least one tongue, and at least one catching foot is provided on an outer surface of the body, said tongue and said foot being designed to keep the body in place in the casing.

12. The connector as claimed in claim 10, wherein the casing comprises at least one tongue, and at least one catching foot is provided on the outer surface of the body, said tongue and said foot being designed to keep the body in place in the casing.

13. A connection assembly, comprising at least two connectors as claimed in claim 10, wherein the armature of the first connector is connected to the armature of the second connector by a joining part, and/or the casing of the first connector and the casing of the second connector are made as a single piece.

14. A system, comprising:

a connector as claimed in claim 1; and a printed circuit board, wherein the contact extends along a longitudinal axis, at least one portion of which is inclined to the plane defined by the printed circuit board.

15. A system, comprising:

a connector as claimed in claim 1; and a printed circuit board, wherein the contact extends along a longitudinal axis, at least one portion of which is perpendicular to the plane defined by the printed circuit board.

16. The connector as claimed in claim 2, wherein the armature is made of bronze or brass.

* * * * *